United States Patent [19]

Pilgrim, Jr.

[11] Patent Number: 4,940,153

[45] Date of Patent: Jul. 10, 1990

[54] DECORATIVE BOTTLE AND METHOD OF FABRICATING

[76] Inventor: Noel I. Pilgrim, Jr., 171-14 119th Ave., St. Albans, N.Y. 11434

[21] Appl. No.: 258,009

[22] Filed: Oct. 14, 1988

[51] Int. Cl.[5] ..... B44C 1/10; B44C 1/14

[52] U.S. Cl. ..... 215/12.2; 428/34.2; 428/34.4; 434/81; 156/63

[58] Field of Search ..... 215/12.2; 156/62, 63; 434/81, 82, 84; 428/34.2, 34.4, 38

[56] References Cited

U.S. PATENT DOCUMENTS

| | | | |
|---|---|---|---|
| 1,063,472 | 6/1913 | Schultz | 434/81 |
| 1,618,263 | 2/1927 | Beardsley | 156/76 X |
| 1,762,082 | 6/1930 | Shiraishi | 215/12.2 |
| 1,813,901 | 7/1931 | Bayne | 434/81 X |
| 1,829,262 | 10/1931 | Cade | 156/183 |
| 2,080,652 | 5/1937 | Cook et al. | 434/84 X |
| 3,125,241 | 3/1964 | Kasper | 428/34.2 X |
| 3,245,857 | 4/1966 | Rutledge | 215/12.2 X |
| 3,420,728 | 1/1969 | Haverstock | 428/38 |
| 3,581,882 | 6/1971 | Bish | 434/81 |
| 3,655,469 | 4/1972 | Huron | 215/12.2 X |
| 4,397,701 | 8/1983 | Johnson et al. | 206/575 X |
| 4,584,042 | 4/1986 | Wandroik | 206/575 X |

FOREIGN PATENT DOCUMENTS

| | | | |
|---|---|---|---|
| 197803 | 3/1978 | Fed. Rep. of Germany | 215/365 |
| 806898 | 12/1936 | France | 434/81 |
| 2572684 | 5/1986 | France | 156/63 |
| 244553 | 12/1985 | Japan | 156/63 |
| 183413 | 9/1936 | Switzerland | 428/34.4 |
| 455557 | 10/1936 | United Kingdom | 434/81 |
| 2065567 | 7/1981 | United Kingdom | 434/81 |

OTHER PUBLICATIONS

Montgomery Wards 1969 Christmas Catalog, p. 282, Kit #48t32238 (on top right of page), 434/81.

*Primary Examiner*—Stephen Marcus
*Assistant Examiner*—Christine A. Peterson
*Attorney, Agent, or Firm*—Richard L. Miller

[57] ABSTRACT

This decorative bottle and method of making same which is designed for being employed as a decorative article for many uses. Primarily, it consists of a bottle of any shape that is coated with an adhesive and covered with puzzle-type cut out pieces taken from newspapers, magazines, maps, etc. These pieces are adhered with their irregular shapes adjacent to similar shapes of the adjacent pieces, and a felt tipped marking pen is employed to the borders of same. Several coats of polyurethane sealant are finally sprayed onto the finished design.

2 Claims, 1 Drawing Sheet

DECORATIVE BOTTLE AND METHOD OF FABRICATING

BACKGROUND OF THE INVENTION

The instant invention relates generally to decorative articles, and more particularly, to a decorative bottle and method of fabricating.

Numerous articles have been provided in the prior art that are adapted to be decorated in various manners. For example, U.S. Pat. Nos. 3,104,498 of Miller, 1,868,853 of Sievers, and 1,689,418 of Young, all are illustrative of such prior art. While these units may be suitable for the particular purpose to which they address, they would not be as suitable for the purpose of the present invention as hereafter described.

SUMMARY OF THE INVENTION

A primary object of the present invention is to provide a decorative bottle and method of fabricating that will overcome the shortcomings of the prior art devices.

Another object is to provide a decorative bottle and method of fabricating that will be unique, in that newspaper print, pictures, maps, magazine pictures, and other things may be employed in the making thereof.

An additional object is to provide a decorative bottle and method of fabricating, that will be used in homes, offices, hotel entrances and rooms, airport entrances, but in greater size, etc.

A further object is to provide a decorative bottle and method of fabricating that is simple and easy to use.

A still further object is to provide a decorative bottle and method of fabricating that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
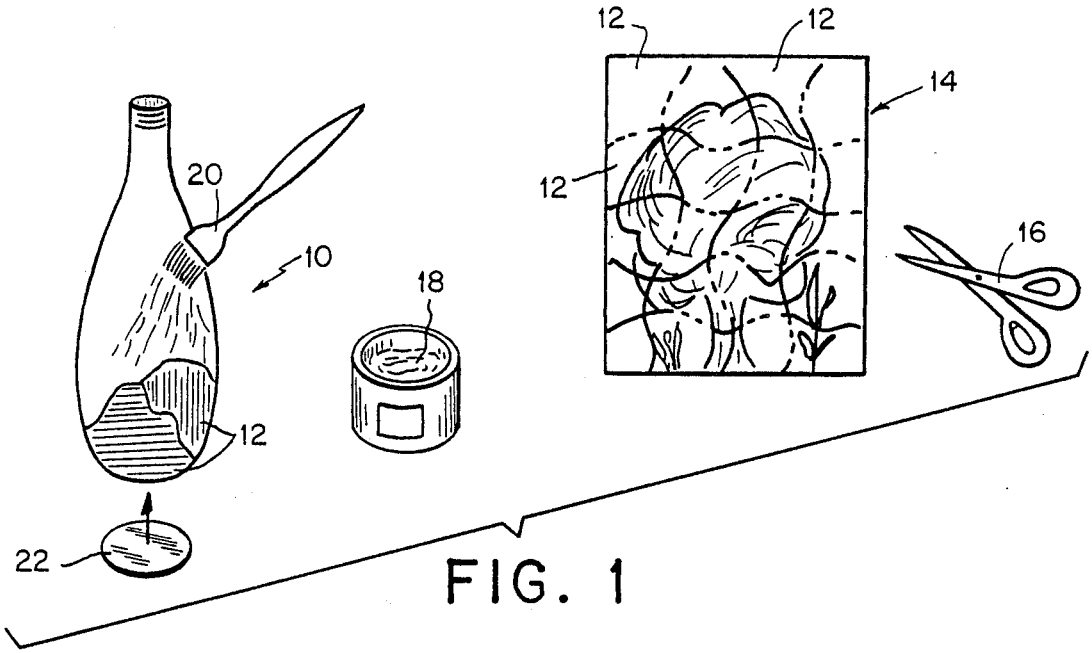
FIG. 1 is a diagrammatic illustration showing the materials and a first step required for fabricating the instant invention.
Figure 2:
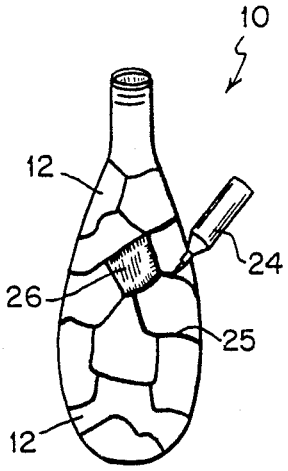
FIG. 2 shows marker being applied to the bottle.
Figure 3:
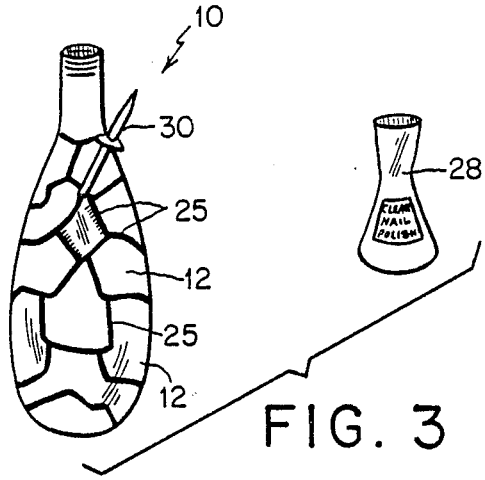
FIG. 3 shows a foil and glitter being applied to the bottle.
Figure 4:
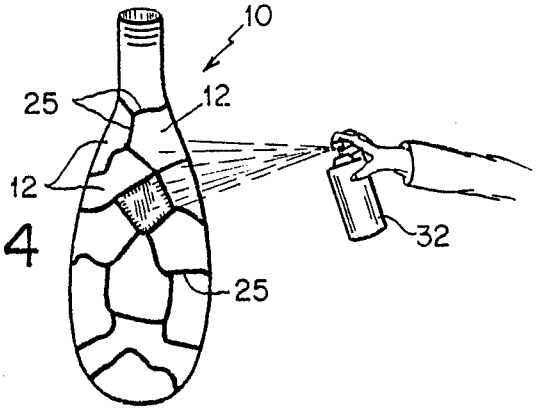
FIG. 4 shows the final completion step.

Turning now descriptively to the drawings, in which like reference characters denote like elements throughout the several views, a bottle 10 is provided with a plurality of pieces 12 that are cut out of a sheet 14 taken from a newspaper article, pictures, a map, or other elements of print from magazines, etc. These pieces 12 are cut out in the manner such as puzzles, with a pair of conventional scissors 16.

A suitable adhesive 18 is first applied to the outer peripheral surface of the bottle 10, for the adhering of the pieces 12 thereto, by a brush 20, and one piece of white art paper 22 is adhered to the bottom surface of the bottle 10 by the same adhesive 18. The above mentioned constitutes the first step of the process of fabrication of the decorative bottle 10. The pieces 12 are irregular in shape and of complimentary outline, so as to fit adjacent to each other and after they are secured to the bottle 10, a felt marker pen 24 is employed to inscribe a wide border line 25 connecting with the outer peripheries of the irregular and complimentary outlines of the pieces 12, thus forming a composite and continuous decorative layout of decorative appearance.

At least one space is left in the design and a design of aluminum foil is cut to conform with the irregular outline configurations of the adjacent pieces 12, and is also adhered in the same manner, the same also being border lined by the pen 24. After the above indicated steps, adhesive is applied with applicator 30 in areas where glitter is desired, then glitter is poured from the container 28 onto prepared tacky adhesive surface.

Finally, a spray can 32 of high gloss polyurethane sealer is employed to spray at least three separate coats of sealer on entire design surface of bottle 10, one at a time.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A decorative bottle comprising design pieces of printed matter having irregular and complementary outlines getting cut out in puzzle manner from a printed sheet such as one of a newspaper, map and magazine picture, and adhered to said bottle's outer surface so as to fit adjacent to each other to form a composite and continuous decorative layout, at least one space between the design pieces filled with at least one metal foil piece cut to conform with the irregular outlines of the design pieces defining the space, a border line marked on borders of adjacent design pieces and on borders of design pieces and adjacent said at least one metal foil, and a spray application of sealant material covering the surface of the design pieces, said at least one foil piece and said border line.

2. A method of fabricating a decorative bottle comprising the steps of:

providing design pieces of printed matter having irregular and complementary outlines;

by cutting out such design pieces in puzzle manner from a printed sheet such as one of a newspaper, map and magazine picture;

adhering said design pieces to said bottle's outer surface so as to fit adjacent to each other with at least one space left therebetween so as to form a composite and continuous decorative layout;

cutting at least one metal foil piece to conform with the irregular outline of the design pieces adjacent the said at least one space;

adhering the said at least one metal foil piece to the bottle surface so as to fill the said at least one space;

marking a line on borders of adjacent pieces of printed matter, and borders of pieces of printed matter and adjacent said at least one metal foil piece;

spraying sealant material to cover the surfaces of the pieces of printed matter, said at least one foiled piece and said border line.

* * * * *